US008292390B2

(12) United States Patent
Furuhata et al.

(10) Patent No.: US 8,292,390 B2
(45) Date of Patent: Oct. 23, 2012

(54) RECORDING APPARATUS, METHOD OF CONTROLLING RECORDING APPARATUS AND COMPUTER READABLE RECORDING MEDIUM

(75) Inventors: Yoshiharu Furuhata, Nagoya (JP); Manabu Hibi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 283 days.

(21) Appl. No.: 12/729,695

(22) Filed: Mar. 23, 2010

(65) Prior Publication Data

US 2010/0245438 A1 Sep. 30, 2010

(30) Foreign Application Priority Data

Mar. 24, 2009 (JP) ..... 2009-072346

(51) Int. Cl.
*B41J 29/38* (2006.01)

(52) U.S. Cl. ..... 347/14

(58) Field of Classification Search ..... 347/14, 347/34–36

See application file for complete search history.

(56) References Cited

U.S. PATENT DOCUMENTS

| | | | | |
|---|---|---|---|---|
| 5,127,064 | A | 6/1992 | Flinois et al. | |
| 2007/0057983 | A1 * | 3/2007 | Kawaguchi et al. | 347/9 |
| 2007/0229561 | A1 * | 10/2007 | Iwao et al. | 347/11 |
| 2008/0174632 | A1 * | 7/2008 | Miyamoto et al. | 347/35 |

FOREIGN PATENT DOCUMENTS

| | | |
|---|---|---|
| JP | 3-156578 | 7/1991 |
| JP | 5-224932 | 9/1993 |
| JP | 2007-136722 | 6/2007 |

* cited by examiner

*Primary Examiner* — Stephen Meier
*Assistant Examiner* — Tracey McMillion
(74) *Attorney, Agent, or Firm* — Scully, Scott, Murphy & Presser, PC

(57) ABSTRACT

Flushing data include pixels that are flushing dot candidates in a virtual area where a plurality of pixels are arranged in a matrix. One or less pixel is arranged in a plurality of rows of pixels arranged in lines extending in the main scan direction and the direction of conveyance of a sheet and third and fourth directions that are orthogonal to each other and that cross each other at an angle of 45°. A head control section controls an inkjet head such that image dots and flushing dots corresponding to flushing dot candidates that pertain to flushing data and that are situated at locations where no image dots are generated, are produced on a sheet.

11 Claims, 10 Drawing Sheets

RECORDING APPARATUS, METHOD OF CONTROLLING RECORDING APPARATUS AND COMPUTER READABLE RECORDING MEDIUM

CROSS REFERENCE TO RELATED APPLICATION

The present application claims priority from Japanese Patent Application NO. 2009-072346, which was filed on Mar. 24, 2009, the disclosure of which is incorporated herein by reference in its entirety.

BACKGROUND

The present invention relates to a recording apparatus having a liquid ejection head for ejecting a liquid, a method of controlling the recording apparatus and a computer readable recording medium storing a program.

A plurality of nozzles for ejecting ink droplets to a recording medium, such as a print sheet, are formed in an inkjet head belonging to an inkjet printer. In such an inkjet head, viscosity of ink in the nozzles sometimes increases with elapse of a time, thereby causing a change in an ink ejection characteristic and an ejection failure. A hitherto known technique for preventing them is to produce image dots pertaining to an image on a recording medium in such a way that ink droplets are ejected from all nozzles before elapse of a predetermined time and let nozzles, which do not contribute to image production, eject ink droplets, thereby producing flushing dots on the recording medium (see; for instance, Patent Document 1). An increase in the viscosity of the ink in the nozzles can thereby be prevented without wasting the recording medium.

SUMMARY

According to the foregoing technique, in order to reduce visibility of flushing dots produced on a sheet, positions of the flushing dots are determined so as not to overlap each other or adjoin each other. However, according to the technique, a plurality of flushing dots may be arranged along a plurality of lines extending in mutually-different directions, and hence visibility of flushing dots is enhanced, thereby deteriorating print quality.

An object of the present invention is to provide a recording apparatus that prevents deterioration of recording quality of a recording medium while preventing an increase in viscosity of a liquid in ejection ports without wasteful consumption of a recording medium.

In order to achieve the object of the invention, an exemplary embodiment of the present invention provides a recording apparatus comprising:

a liquid ejection head including a plurality of ejection ports for ejecting droplets toward a recording medium;

an image data storage which stores image data showing positions of a plurality of image dots which make up an image to be produced on the recording medium by the droplets ejected from the liquid ejection head; and a head controller which controls ejection of droplets from the liquid ejection head, wherein the head controller:

controls the liquid ejection head according to the image data stored in the image data storage so that plurality of image dots are formed on the recording medium by droplets ejected from the ejection ports; and controls the liquid ejection head so that flushing dots are produced on the recording medium by droplets auxiliary ejected from the ejection ports not contributing to production of the image dots before recording on the recording medium is completed, so that the flushing dots are formed so as not to be adjacent to each other, and so that one or less of the flushing dot is formed in respective lines belonging to at least one of a set of two lines extending in a first direction and a second direction orthogonal to the first direction and a set of two lines extending in third and fourth directions that are orthogonal to each other and respectively cross with the first and second directions at the same angle.

Further, the exemplary embodiment of the present invention provides a method of controlling a recording apparatus which includes: a liquid ejection head including a plurality of ejection ports for ejecting droplets toward a recording medium, and an image data storage which stores image data showing positions of a plurality of image dots which make up an image to be produced on the recording medium by the droplets ejected from the liquid ejection head, the method comprising:

controlling the liquid ejection head according to the image data stored in the image data storage so that plurality of image dots are formed on the recording medium by droplets ejected from the ejection ports; and controlling the liquid ejection head so that flushing dots are produced on the recording medium by droplets auxiliary ejected from the ejection ports not contributing to production of the image dots before recording on the recording medium is completed, so that the flushing dots are formed so as not to be adjacent to each other, and so that one or less of the flushing dot is formed in respective lines belonging to at least one of a set of two lines extending in a first direction and a second direction orthogonal to the first direction and a set of two lines extending in third and fourth directions that are orthogonal to each other and respectively cross with the first and second directions at the same angle.

Further, the exemplary embodiment of the present invention provides a computer readable recording medium storing a program which causes a recording apparatus, which includes: a liquid ejection head including a plurality of ejection ports for ejecting droplets toward a recording medium, and an image data storage which stores image data showing positions of a plurality of image dots which make up an image to be produced on the recording medium by the droplets ejected from the liquid ejection head, to perform:

controlling the liquid ejection head according to the image data stored in the image data storage so that plurality of image dots are formed on the recording medium by droplets ejected from the ejection ports; and controlling the liquid ejection head so that flushing dots are produced on the recording medium by droplets auxiliary ejected from the ejection ports not contributing to production of the image dots before recording on the recording medium is completed, so that the flushing dots are formed so as not to be adjacent to each other, and so that one or less of the flushing dot is formed in respective lines belonging to at least one of a set of two lines extending in a first direction and a second direction orthogonal to the first direction and a set of two lines extending in third and fourth directions that are orthogonal to each other and respectively cross with the first and second directions at the same angle.

BRIEF DESCRIPTION OF THE DRAWINGS

FIGS. 6A and 6B are schematic illustrations of a flushing pattern stored in a flushing data storage section shown in FIG. 5, wherein FIG. 6A shows a virtual area representing a flushing pattern, and FIG. 6B shows a pixel matrix unit group including a plurality of pixel matrix groups;

FIGS. 7A and 7B are schematic illustrations of a flushing pattern stored in a flushing data storage section shown in FIG. 5, wherein FIG. 7A shows a pixel matrix unit group including a plurality of pixel matrix units, and FIG. 7B shows a pixel matrix unit including a plurality of pixels;

DESCRIPTION OF EXEMPLARY EMBODIMENTS

A preferred embodiment of the present invention is hereunder described by reference to the drawings.

Figure 1:
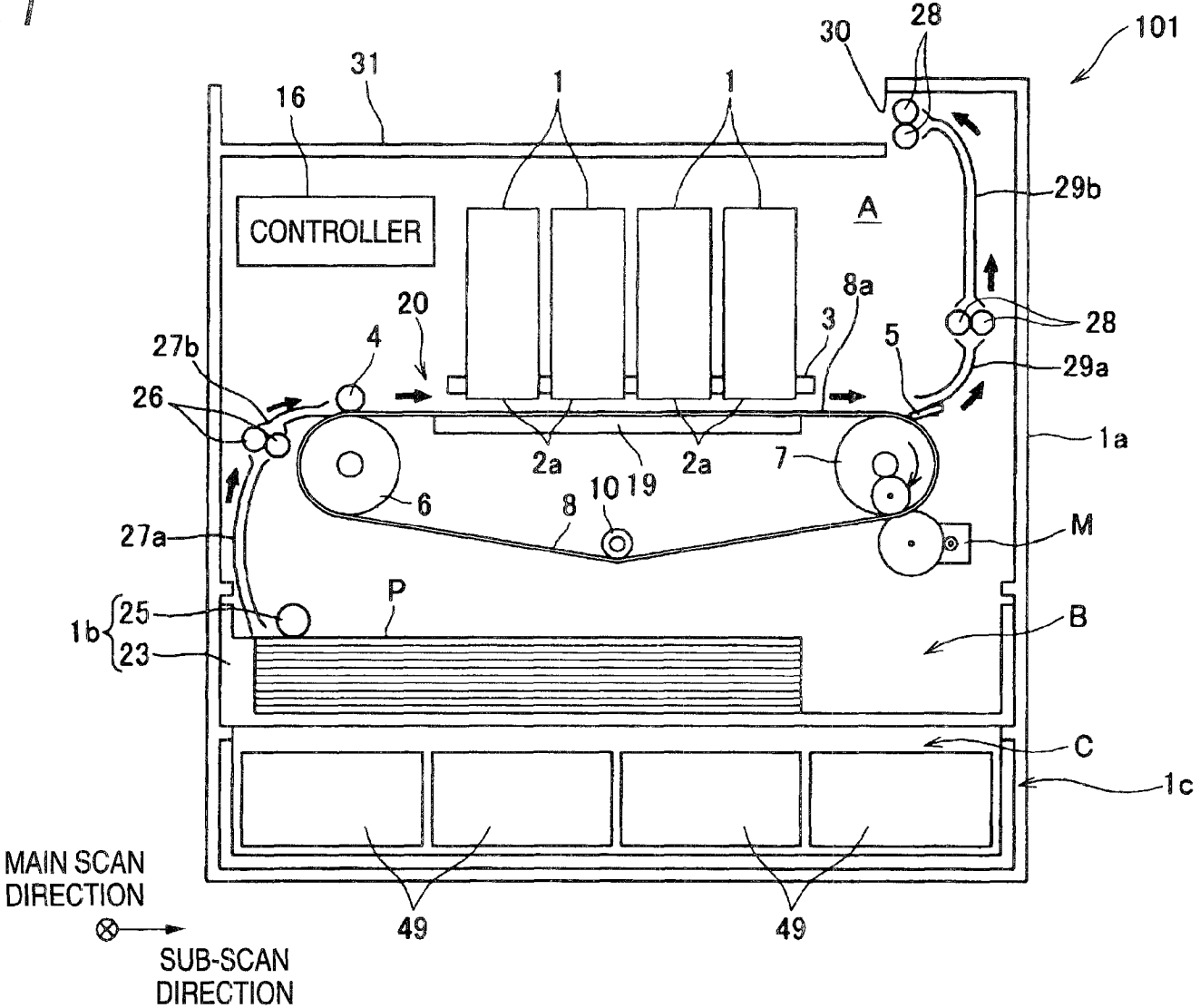
FIG. 1 is a cross sectional view of an inkjet printer of an embodiment of the present invention.

As shown in FIG. 1, an inkjet printer 101 includes a parallelepiped housing 1*a*. A sheet output section 31 is provided in an upper portion of the housing 1*a*. An interior of the housing 1*a* is divided, in sequence from top, three spaces A, B, and C. Four inkjet heads 1 that respectively eject magenta ink, cyan ink, yellow ink, and black ink and a conveyance unit 20 are arranged in the space A. A sheet feed unit 1*b* removably attached to the housing 1*a* is disposed in the space B, and an ink tank unit 1*c* is disposed in the space C. In the embodiment, a sub-scan direction is a direction parallel to the conveyance direction in which a sheet P is conveyed by a conveyance unit 20. A main scan direction is a direction that is orthogonal to the sub-scan direction and that is aligned to a horizontal plane.

A sheet conveyance path along which the sheet P is to be conveyed from the sheet feed unit 1*b* to the sheet output section 31 is formed in the inkjet printer 101 (as designated by an arrow of medium width shown in FIG. 1). The sheet feed unit 1*b* includes a sheet feed tray 23 capable of housing a plurality of sheets P and a sheet feed roller 25 attached to the sheet feed tray 23. The sheet feed roller 25 feeds the topmost sheet P among a plurality of sheets P stocked in a piled manner in the sheet feed tray 23. The sheet P fed by the sheet feed roller 25 is fed to the conveyance unit 20 while being guided by guides 27*a* and 27*b* and nipped between a pair of feed rollers 26.

The conveyance unit 20 includes two belt rollers 6 and 7; an endless conveyance belt 8 wrapped around the rollers so as to extend between the rollers 6 and 7; and a tension roller 10. The tension roller 10 is downwardly forced while remaining in contact with an internal peripheral surface of a lower loop of the conveyance belt 8, to thus impart tension to the conveyance belt 8. The belt roller 7 is a drive roller and rotated in a clockwise direction in FIG. 1 when imparted with drive force from a conveyance motor M through two gears. The belt roller 6 is a driven roller and rotated by rotation of the belt roller 7 in the clockwise direction in FIG. 1 along with travel of the conveyance belt 8.

An outer peripheral surface 8*a* of the conveyance belt 8 is subjected to silicon treatment and exhibits adhesiveness. A nip roller 4 is disposed at a position along the sheet conveyance path so as to oppose the belt roller 6 with the conveyance belt 8 sandwiched therebetween. The nip roller 4 presses the sheet P fed out of the sheet feed unit 1*b* against the outer peripheral surface 8*a* of the conveyance belt 8. The sheet P pressed against the outer peripheral surface 8*a* is conveyed in a rightward direction in FIG. 1 while held on the outer peripheral surface 8*a* by adhesiveness of the outer peripheral surface.

A separation plate 5 is disposed at a position on the sheet conveyance path where the separation plate opposes the belt roller 7 with the conveyance belt 8 sandwiched therebetween. The separation plate 5 separates the sheet P from the outer peripheral surface 8*a*. The thus-separated sheet P is conveyed while guided by guides 29*a* and 29*b* and nipped by two feed roller pairs 28 and output to the sheet output section 31 from an opening 30 formed in the upper portion of the housing 1*a*.

Four inkjet heads 1 are supported by the housing 1*a* through a frame 3. The four inkjet heads 1 extend along the main scan direction and are arranged in parallel to each other along the sub-san direction. The inkjet printer 101 is a line-type color inkjet printer in which an ejection area extending in the main scan direction is formed. A lower surface of each of the inkjet heads 1 is an ejection surface 2*a* through which ink droplets are ejected.

A platen 19 is arranged in the loop of the conveyance belt 8 and is opposed to the four inkjet heads 1. An upper surface of the platen 19 remains in contact with an internal peripheral surface of an upper loop of the conveyance belt 8 and supports the conveyance belt 8 from its inner peripheral side. The outer peripheral surface 8*a* of the upper loop of the conveyance belt 8 is opposed the lower surfaces of the inkjet heads 1, namely, the ejection surfaces 2*a*, in parallel to each other, whereby clearance of predetermined interval suitable for producing an image is created. The clearance makes up a portion of the sheet conveyance path. When the sheet P conveyed by the conveyance belt 8 passes by positions located immediately below the respective heads 1, respective colors of ink are sequentially ejected toward an upper surface of the sheet P from the respective heads 1, whereupon a desired color image is produced on the sheet P.

The respective inkjet heads 1 are connected to respective ink tanks 49 set in the ink tank unit 1*c* provided in the space C. The four ink tanks 49 store ink to be ejected by the corresponding ink jet heads 1, respectively. Ink is supplied from each of the ink tanks 49 to the corresponding inkjet head 1 through a tube (not shown), or the like.

The inkjet heads 1 are now described in detail by reference to FIGS. 2 and 3. A lower housing 87 is omitted from FIG. 3.

Figure 2:
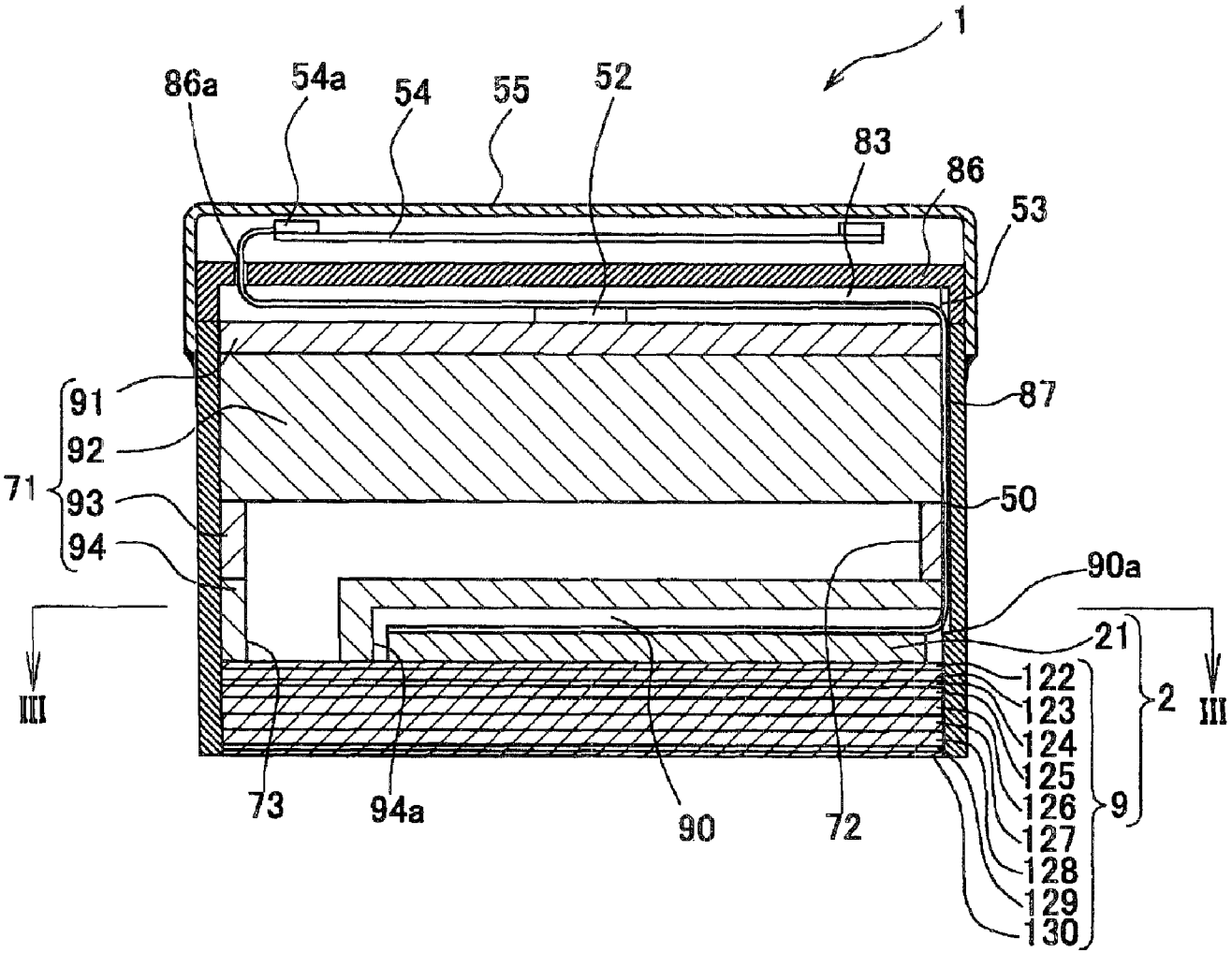
FIG. 2 is a cross sectional view of the inkjet head shown in FIG. 1 taken along its widthwise direction.

As shown in FIG. 2, each of the inkjet heads 1 includes a reservoir unit 71; a head main body 2 including a flow channel unit 9 and an actuator unit 21; and a COF (Chip On Film: a flat flexible substrate) 50 that is connected at its one end to the actuator unit 21 and that is equipped with a driver IC 52; and a control substrate 54 to which the other end of the COF 50 is connected. The inkjet head 1 includes the reservoir unit 71; an upper housing 86 and the lower housing 87 that make up a box surrounding the flow channel unit 9; and a head cover 55 that encloses the control substrate 54 at a position above the upper housing 86.

The reservoir unit 71 is a flow channel formation member that is fixed to an upper surface of the head main body 2 and that supplies the head main body 2 with ink. The reservoir unit 71 is a multilayered substance formed by stacking four mutually-positioned plates 91 to 94. An unillustrated ink inflow channel, the ink reservoir 72, and ten ink outflow channels 73 are formed in the reservoir unit so as to mutually communicate with each other. Only one of the ink outflow channels 73 is shown in FIG. 2. The ink inflow channel is a channel into which ink flows from the ink tank 49. The ink reservoir 72 temporarily stores an inflow of ink from the ink inflow channel. The ink outflow channel 73 is a flow channel through which ink flows from the ink reservoir 72 and that is in mutual communication with an ink supply port 105*b* formed in an upper surface of the flow channel unit 9. Ink from the ink tank 49 flows into the ink reservoir 72 through the ink inflow channel, passes through the ink outflow channel 73, and is supplied from the ink supply port 105*b* to the flow channel unit 9.

An indentation 94*a* is formed in a lower surface of the plate 94. The indentation 94 creates clearance 90 between the lower surface of the plate and an upper surface of the flow channel unit 9. The four actuator units 21 on the flow channel unit 9 are arranged at equal intervals in the clearance 90 along the longitudinal direction of the flow channel unit 9. In a side surface of the multilayered substance, four openings 90*a* of the clearance 90 are formed at equal intervals in a staggered pattern and along the longitudinal direction of the reservoir unit 71.

Protuberances (areas other than the indentation 94*a*) on the lower surface of the plate 94 are adhered to the flow channel unit 9. The ink outflow channels 73 are formed in the respective protuberances.

A neighborhood of one end of the individual COF 50 is connected to an upper surface of the corresponding actuator unit 21. The COF 50 extends from the upper surface of the actuator unit 21 in a horizontal direction and passes through the opening 90*a*. The COF thus passed through the opening is then curved and bent at substantially right angles in an upward direction. The thus-bent COF passes through a cutout 53 formed in an interior wall surface of the upper housing 86 and the lower housing 87 and is pulled to a position above the reservoir unit 71. The COF 50 further extends in a leftward direction in FIG. 2 at a position above the reservoir unit 71 and pulled to a position above the upper housing 86 through a slit 86*a* formed in the upper housing 86. The other end of the COF 50 is connected to the corresponding control substrate 54 through a connector 54*a* at a position above the upper housing 86. A driver IC 52 is mounted at an arbitrary position on the COF 50. The driver IC 52 is affixed to the upper surface of the reservoir unit 71 and thermally coupled to the reservoir unit 71. Heat given off by the driver IC 52 thereby propagates to the reservoir unit 71, whereupon the driver IC 52 is cooled. On the other hand, ink in the reservoir unit 71 is heated, to thus hinder an increase in viscosity of ink.

The control substrate 54 is placed at a position above the upper housing 86 and controls actuation of the actuator unit 21 through the driver IC 52 of the COF 50. The driver IC 52 is for generating a drive signal for actuating the actuator unit 21.

The head main body 2 is now described with reference to FIGS. 3 and 4. Pressure chambers 110, apertures 112, and ejection ports 108, which are located beneath the actuator unit 21 and which are to be drawn in broken lines, are drawn in solid lines in FIG. 4 for the sake of explanation.

Figure 3:
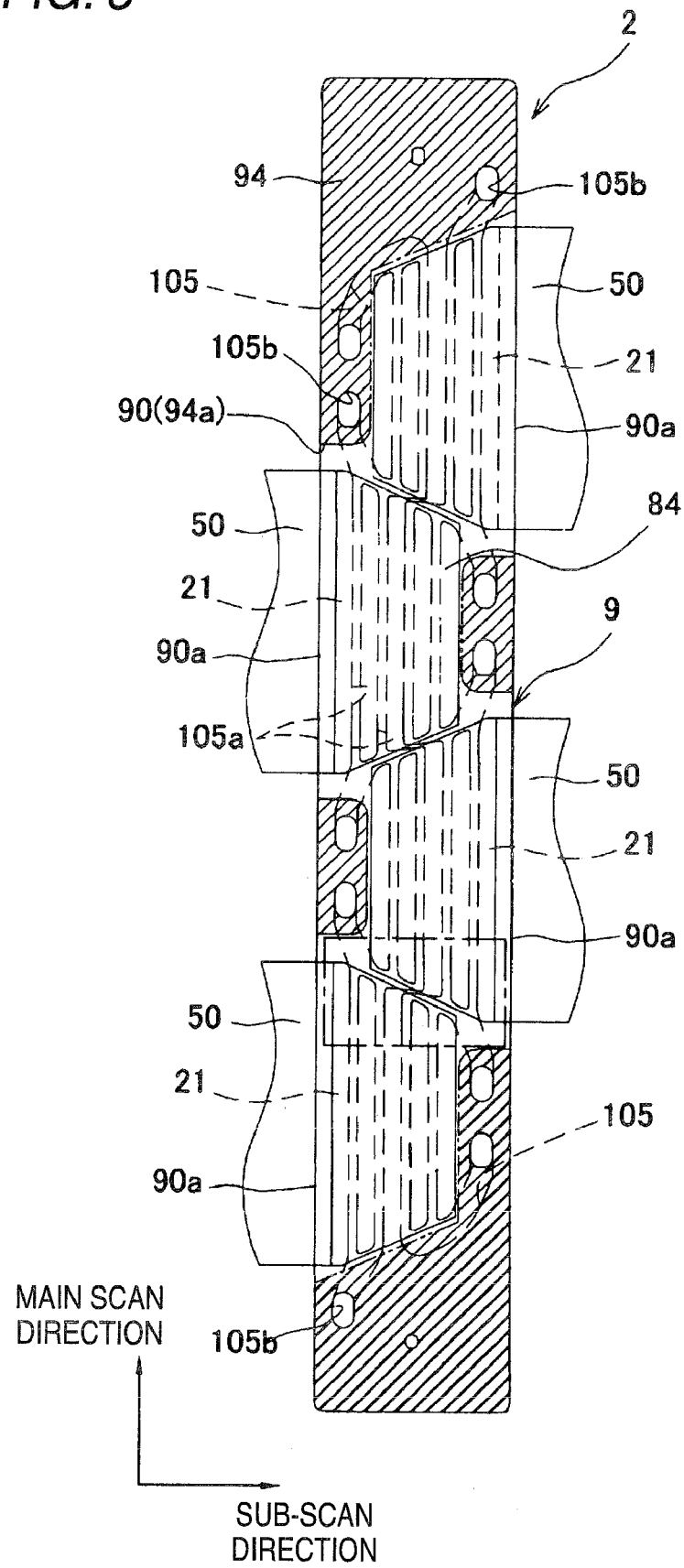
FIG. 3 is a cross sectional view taken along line shown in FIG. 2.
Figure 4:
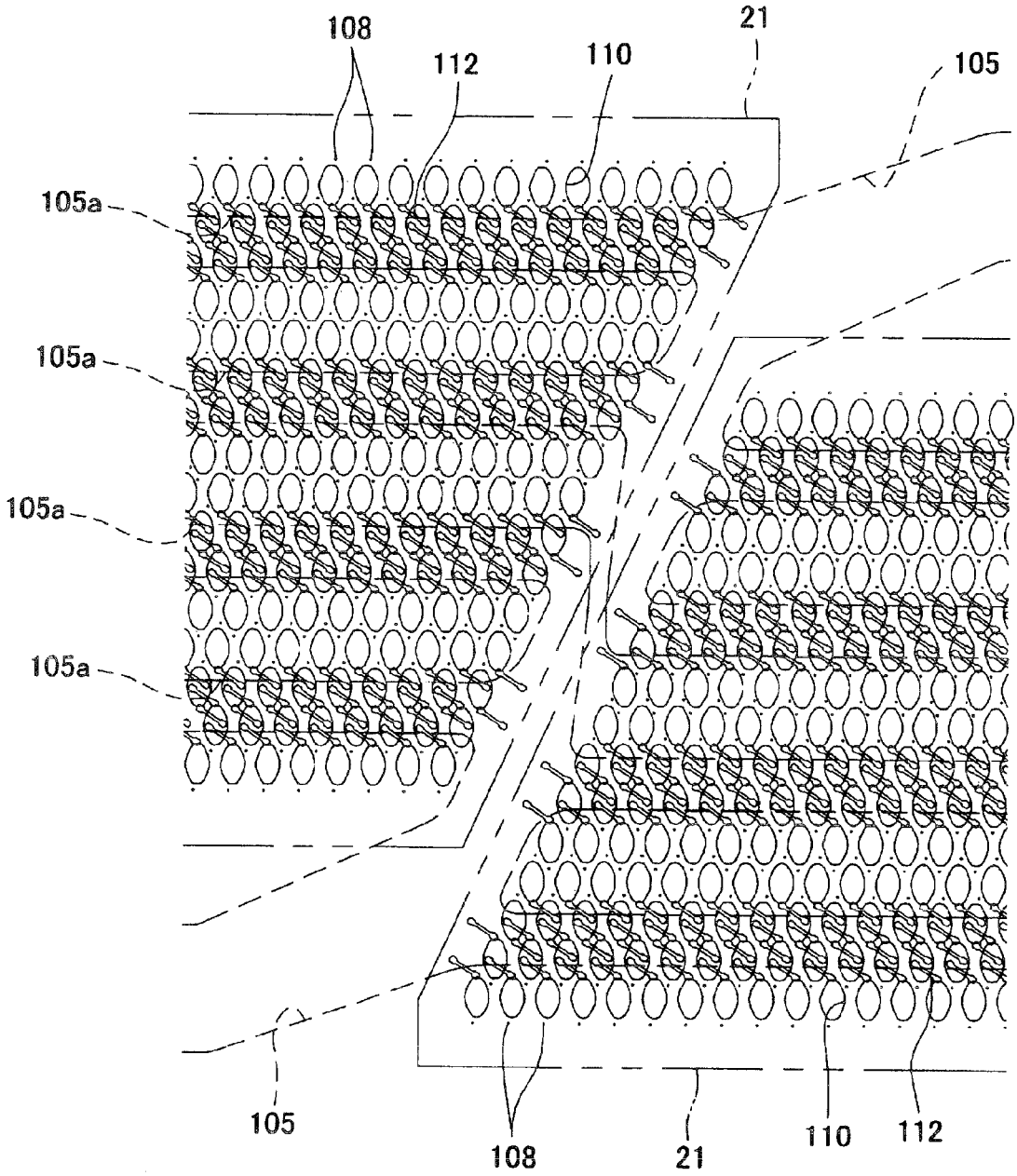
FIG. 4 is an enlarged view of an area enclosed by a dashed line shown in FIG. 3.

As shown in FIG. 3, the head main body 2 is a multilayered substance in which the four actuator units 21 are fixed to the upper surface 9*a* of the flow channel unit 9. As shown in FIGS. 3 and 4, ink flow channels, including the pressure chambers 110, are formed in the flow channel unit 9. Each of the actuator units 21 includes a plurality of actuators assigned to the respective pressure chambers 110 and has a function of selectively imparting ejection energy to ink stored in the respective pressure chambers 110.

The flow channel unit 9 assumes the shape of a rectangular parallelepiped having substantially the same planar shape as that of the plate 94 of the reservoir unit 71. A total of ten ink supply ports 105*b* are formed in the upper surface 9*a* of the now channel unit 9 in correspondence with the ink outflow channels 73 of the reservoir unit 71 (see FIG. 2). As shown in FIG. 3, there are formed in the flow channel unit 9 a manifold flow channel 105 remaining in mutual communication with the ink supply ports 105*b*, a sub-manifold 105*a* branched off from the manifold flow channel 105, and a plurality of individual ink flow channels 132 branched off from the sub-manifold flow channel 105*a*. As shown in FIG. 1, the ejection surfaces 2*a* are formed on a lower surface of the flow channel unit 9, and as shown in FIG. 4, the plurality of ejection ports 108 are arranged in the ejection surfaces in a matrix pattern. The plurality of pressure chambers 110 are also arranged in a matrix pattern in the upper surface 9*a* of the flow channel unit 9 (i.e., the surface to which the actuator units 21 are fixed). The ejection ports 108 are arranged, along the main scan direction, at an interval of 600 dpi that is a resolution achieved in the main scan direction.

In the embodiment, sixteen rows of the pressure chambers 110 that are equally spaced along the longitudinal direction of the flow channel unit 9 are arranged in parallel to each other along a widthwise direction. The number of pressure chambers 110 included in each of the rows of pressure chambers becomes gradually smaller from a long side (a lower bottom side) to a short side (an upper bottom side) in correspondence with the outer shape (a trapezoidal shape) of the actuator unit 21 to be described later. The ejection ports 108 are also arranged correspondingly.

The flow channel unit 9 is made by stacking, in a positioning fashion, a plurality of metal plates made of stainless steel, whereby ink flow channels extending from the manifold flow channel 105 to the ejection ports 108 through the pressure chambers 110 are formed in the flow channel unit 9.

Ink flow in the flow channel unit 9 is now described. As shown in FIGS. 3 and 4, the ink supplied from the reservoir unit 71 into the flow channel unit 9 through the ink supply port 105*b* is distributed from the manifold flow channel 105 to the sub-manifold flow channels 105*a*. The ink in the sub-manifold flow channels 105*a* flows into the individual ink flow channels and reaches the ejection ports 108 through the pressure chambers 110.

The actuator units 21 are unimorph actuators. The unimorph actuator includes lead zirconate titanate (PZT)-based piezoelectric c sheet made of ceramic exhibiting ferroelectricity. Upon receipt of an input of a drive signal, each of the actuator units 21 selectively imparts pressure (ejection energy) to the ink in respective pressure chambers 110, thereby ejecting ink droplets from corresponding ejection ports 108.

Figure 5:
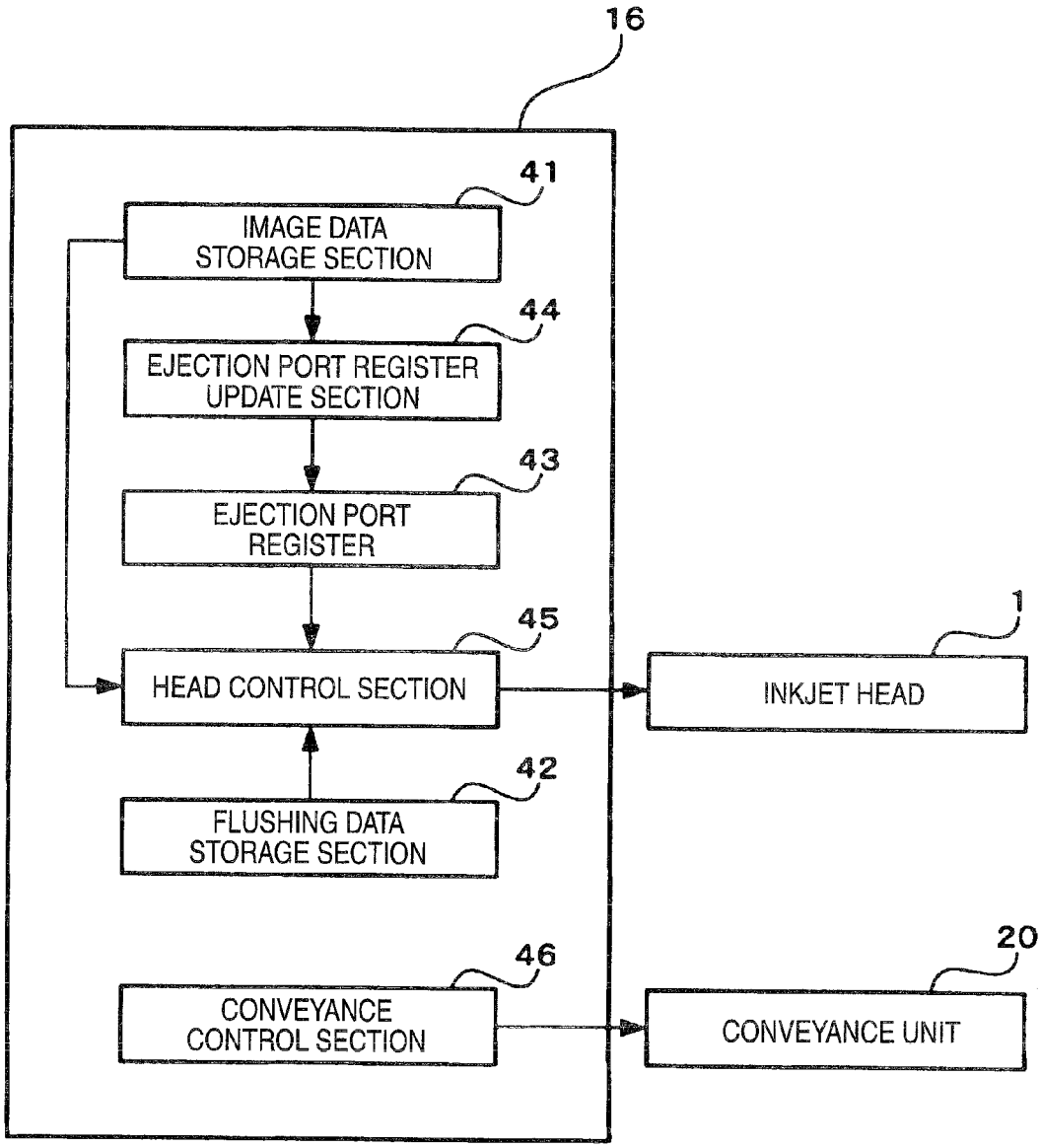
FIG. 5 is a functional block diagram of a controller shown in FIG. 1.

The controller 16 is now described by reference to FIG. 5. The controller 16 includes a CPU (Central Processing Unit); EEPROM (Electrically Erasable and Programmable Read Only Memory) that rewritably stores a program to be executed by the CPU and data used for the program; and RAM (Random Access Memory) that temporarily stores data at the time of execution of the program. Respective function sections making up the controller 16 are built as a result of the hardware and software in the EEPROM acting synergistically. As shown in FIG. 5, the controller 16 controls the entirety of the inkjet printer 101 and has an image data storage section 41, a flushing data storage section 42, an ejection port register 43, an ejection port register update section 44, a head control section 45, and a conveyance control section 46.

The image data storage section 41 stores image data pertaining to an image to be printed on the sheet P. The image data allocate the volume of an ink droplet to be ejected, which make up an image to each of the ejection ports 108 of each inkjet head 1 at every print cycle. Ink droplets are ejected according to the data, whereupon respective image dots making up a desired image are produced in a print area on the sheet P. A print cycle is a time consumed during conveyance of the sheet P over a unit distance commensurate with a print resolution and in a direction of conveyance of the sheet P. In the present embodiment, ink droplets ejected from the ejection ports 108 to produce image dots correspond to any selected from ink droplets having three types of volumes (i.e., large ink droplets, medium ink droplets, and small ink droplets). The image data represent positions of image dots, which are to be produced on the sheet P, on a virtual sheet P' that is a representation of the sheet P in a data space (see FIG. 6). The virtual sheet P' is a virtual area where a plurality of pixels (virtual pixels) are arranged in a matrix pattern in the main scan direction and the direction of conveyance of a sheet. A distance between pixels achieved in the direction of conveyance of a sheet corresponds to a unit distance commensurate with a print resolution achieved in the direction of conveyance of a sheet. Further, a distance between pixels achieved in the main scan direction corresponds to a distance between the ejection ports 108 achieved in the main scan direction. The respective virtual pixels on the virtual sheet P' are located at positions correlated with any of the ejection ports 108 of the respective inkjet heads 1 with respect to the main scan direction.

The flushing data storage section 42 stores, on a per-color basis, flushing data pertaining to a flushing pattern drawn on the sheet P by flushing dots. Flushing data are for directing that the respective ejection ports 108 belonging to the respective inkjet heads 1 should or should not eject ink droplets for flushing purpose. Ink droplets are ejected in accordance with the data, and flushing dots arranged in a flushing pattern are formed in a flushing area on the sheet P. Flushing data include data pertaining to respective colors of flushing patterns. Each of the flushing patterns includes a plurality of candidates for flushing dots (hereinafter called "flushing dot candidates") capable of producing flushing dots and determines a layout form for flushing dots on the sheet P. The flushing data show positions of the flushing dot candidates on the virtual sheet P'. The flushing data stored in the flushing data storage section 42 are described in detail by referring to FIGS. 6 and 7. In FIG. 7, pixels 84*a* represent flushing dot candidates pertaining to the ejection ports 108 of the yellow inkjet head 1. Pixels 84*b* represent flushing dot candidates pertaining to the ejection ports 108 of the magenta inkjet head 1. Pixels 84*c* represent flushing dot candidates pertaining to the ejection ports 108 of the cyan inkjet head 1. Pixels 84*d* represent flushing dot candidates pertaining to the ejection ports 108 of the black inkjet head 1.

Figure 6:
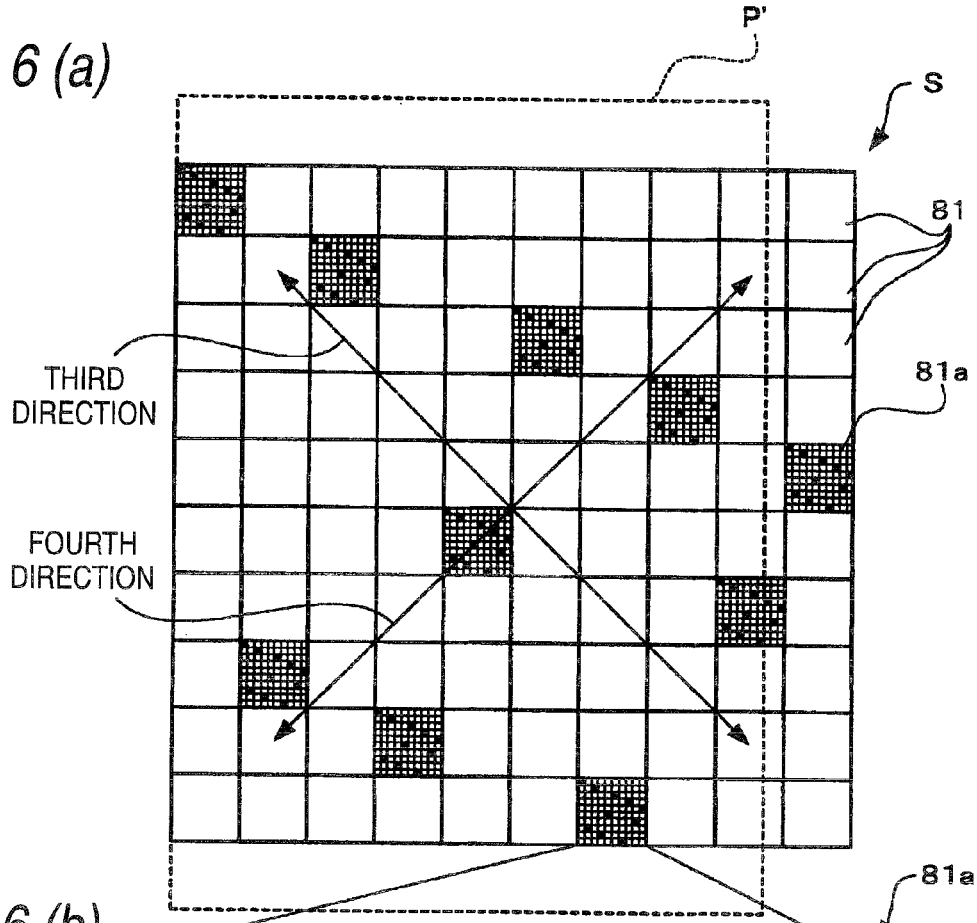
Figure 6:
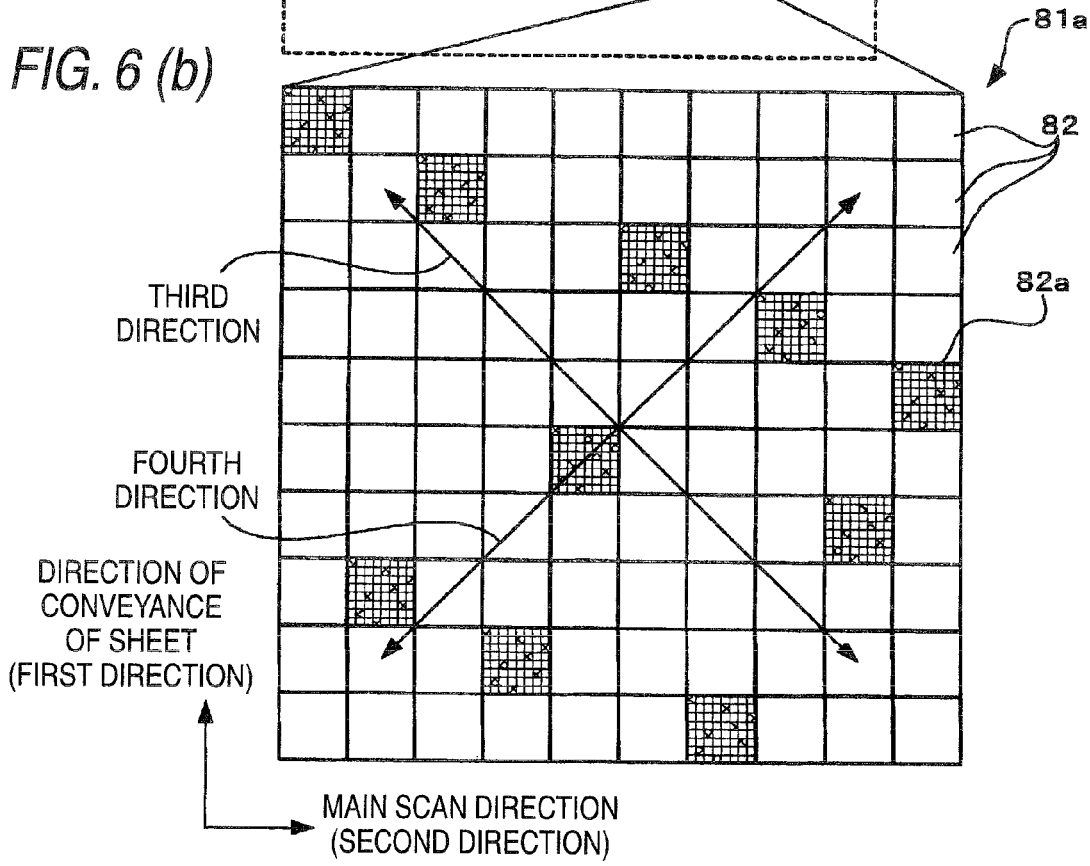
Figure 7:
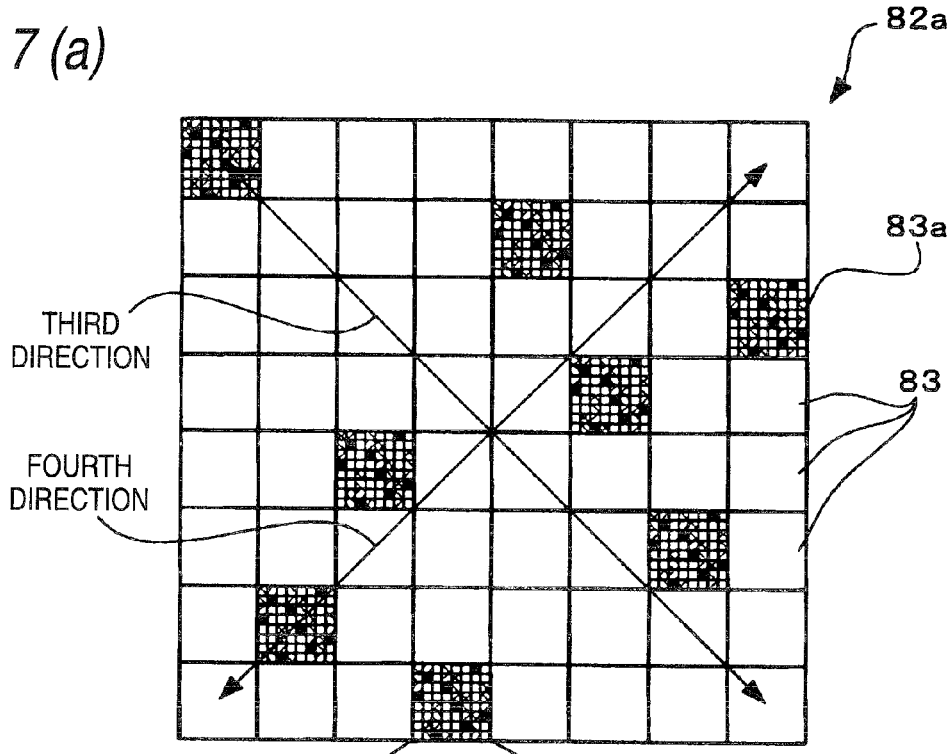
Figure 7:
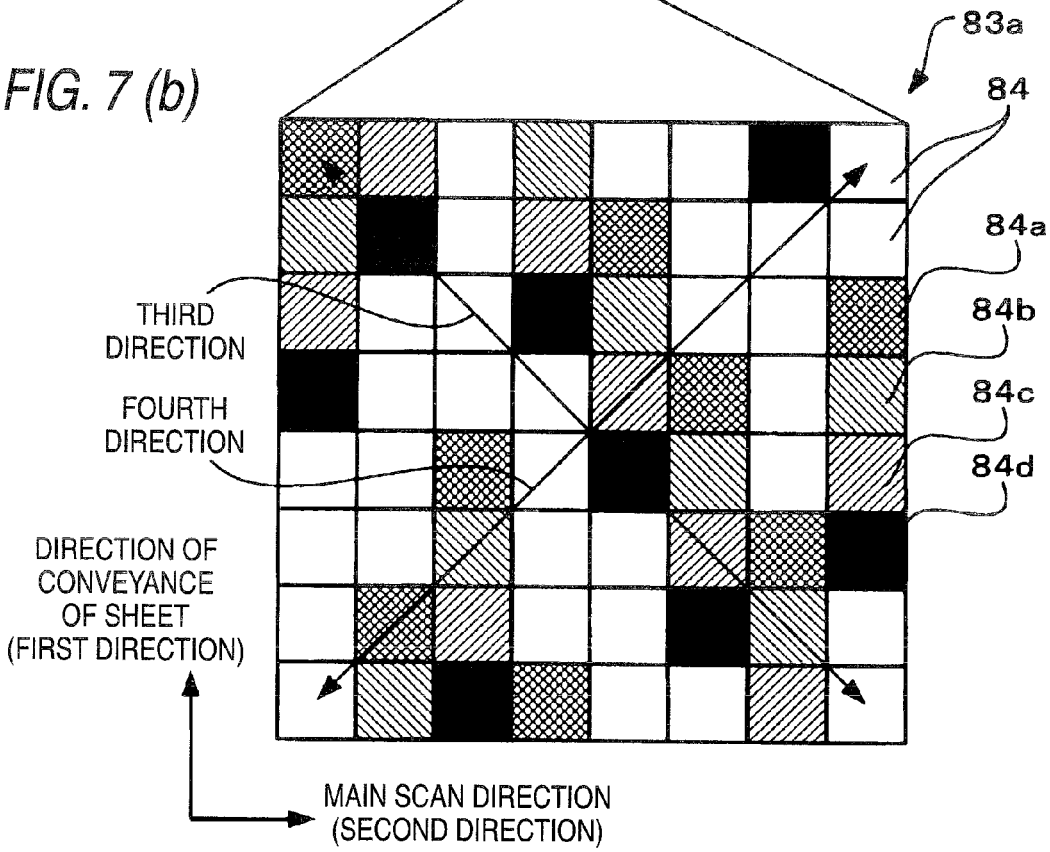

As shown in FIGS. 6 and 7, the flushing pattern shows positions in a virtual area S in the data space where the flushing dot candidates are arranged. The virtual area S is an area including the pixels 84 arranged in a 6400 by 6400 matrix as will be described later. The positions of the pixels 84 in the virtual space S correspond to positions on the sheet P where image dots and flushing dots can be produced.

As shown in FIG. 6A, the virtual area S includes 100 pixel matrix unit groups 81 arranged in a 10 by 10 matrix. Each of the pixel matrix unit groups 81 includes 100 pixel matrix unit groups 82 arranged in a 10 by 10 matrix, as shown in FIG. 6B. Each of the pixel matrix unit groups 82 includes 64 pixel matrix units 83 arranged in an 8 by 8 matrix, as shown in FIG. 7A. Further, each of the pixel matrix units 83 includes 64 pixels 84 arranged in an 8 by 8 matrix, as shown in FIG. 7B. In the virtual area S, a distance between pixels achieved in the direction of conveyance of a sheet (a first direction) and the main scan direction (a second direction) is equal to a distance between pixels on the virtual sheet P'. The pixel matrix unit 83 including flushing dot candidates is denoted by reference symbol 83*a*, to thus be distinguished from a pixel matrix unit not including flushing dot candidates. Likewise, the pixel matrix unit group 82 including flushing dot candidates is hereinbelow denoted by reference symbol 82*a*, and the pixel matrix unit group 81 including flushing dot candidates is hereunder denoted by reference symbol 81*a*.

As shown in FIG. 6A, the virtual area S includes the pixel matrix unit groups 81 arranged in a 10 by 10 matrix. In connection with the flushing pattern pertaining to each of the inkjet heads 1, only one pixel matrix unit group 81*a* including pixels 84*a* to 84*d* that are flushing dot candidates, is arranged in a column including a plurality of pixel matrix unit groups 81 aligned in a first direction corresponding to the direction of conveyance of the sheet as well as in a row that is made of a plurality of pixel matrix unit groups 81 aligned in a second direction corresponding to the main scan direction. Moreover, one or less pixel matrix unit group 81*a* is arranged in a line including a plurality of pixel matrix unit groups 81 aligned in a third direction crossing each of the first and second directions at an angle of 45° (refer to a direction of arrow in the drawing) as well as in a line including a plurality of pixel matrix unit groups 81 aligned in a fourth direction crossing each of the first and second directions at an angle of 45° (refer to a remaining direction of arrow in the drawing), wherein the third direction and the fourth direction cross each other at right angles.

Moreover, as shown in FIG. 6B, the pixel matrix unit groups 82*a*, each of which includes the pixels 84*a* to 84*d* corresponding to flushing dot candidates, are arranged in each pixel matrix unit group 81*a* so as to assume the same layout pattern where the pixel matrix unit groups 81*a* are arranged in the virtual area S. Specifically, in each of the pixel matrix unit groups 81*a*, only one pixel matrix unit group 82*a* is arranged in a column including a plurality of pixel matrix unit groups 82 aligned in the first direction as well as in a row that is made of a plurality of pixel matrix unit groups 82 aligned in the second direction. Moreover, in each of the pixel matrix unit groups 81*a*, the only one or less pixel matrix unit group 82*a* is arranged in a line including a plurality of pixel matrix unit groups 82 aligned in the third direction as well as in a line including a plurality of pixel matrix unit groups 82 aligned in the fourth direction.

Moreover, as shown in FIG. 7A, the pixel matrix units 83*a*, each of which includes the pixels 84*a* to 84*d* corresponding to flushing dot candidates, are arranged in each of the pixel matrix unit groups 82*a* so as to assume the same layout pattern where the pixel matrix unit groups 82*a* are arranged in each of the pixel material unit groups 81*a*. Specifically, only one pixel matrix unit 83*a* is arranged in a column including a plurality of pixel matrix units 83 aligned in the first direction as well as in a row that is made of a plurality of pixel matrix units 83 aligned in the second direction. Moreover, the only one or less pixel matrix unit 83*a* is arranged in a line including a plurality of pixel matrix units 83 aligned in the third direction as well as in a line including a plurality of pixel matrix units 83 aligned in the fourth direction.

Moreover, as shown in FIG. 7B, the pixels 84*a*, which are flushing dot candidates pertaining to the yellow inkjet head 1, are arranged in each of the pixel matrix units 83*a* so as to assume the same layout pattern where the pixel matrix units 83*a* are arranged in each of the pixel material unit groups 82*a*. Specifically, in each of the pixel matrix units 83*a*, only one pixel 84*a* is arranged in a column including a plurality of pixels 84 aligned in the first direction as well as in a row that is made of a plurality of pixels 84 aligned in the second direction. Moreover, in each of the pixel matrix units 83*a*, the only one or less pixel 84*a* is arranged in a line including a plurality of pixels 84 aligned in the third direction as well as in a line including a plurality of pixels 84 aligned in the fourth direction.

In each of the column shown in FIG. 7B, the pixel 84*a* is sequentially followed, in a downward direction, by the pixel 84*b*, the pixel 84*c*, and the pixel 84*d* so as to assume a layout pattern in which they are out of phase with each other by one pixel 84, wherein the pixel 84*b* includes arranged flushing dot candidates pertaining to the magenta inkjet head 1; the pixel 84*c* includes arranged flushing dot candidates pertaining to the cyan inkjet head 1; and the pixel 84*d* includes arranged flushing dot candidates pertaining to the black inkjet head 1. The respective pixels 84*b* to 84*d* are arranged, at this time, so as to be sequentially out of alignment with each other by one pixel along the direction of conveyance of a sheet with reference to the position of the pixel 84*a*. The pixel matrix unit 83*a* is an 8 by 8 matrix space. Therefore, when the pixel 84*a* is situated in the vicinity of an end in the direction of conveyance of a sheet, any of the other pixels 84*b* to 84*d* is situated, along the direction of conveyance of a sheet, at an end opposed to the end where the pixel 84*a* is situated. When the pixel 84*a* is further followed by the pixels 84*b* to 84*d*, they are sequentially arranged in the direction of arrangement. Therefore, the pixels 84*a* to 84*d* are arranged at mutually-different positions.

As mentioned above, the pixels 84*a* to 84*d* that are flushing dot candidates are arranged at mutually-different locations in the virtual area S including a flushing pattern appropriate for each of the inkjet heads 1. In relation to the flushing pattern pertaining to one inkjet head 1, the pixels 84*a* to 84*d* are arranged in such a way that only one pixel is arranged in four lines of pixels 84 respectively extending along the four directions (the first direction to the fourth direction) as mentioned above. Put another way, one pixel is arranged in each of lines belonging to a set of two lines extending in the first and second directions, and one pixel or less is arranged in each of lines belonging to a set of two lines extending in the third and fourth directions, such that the flushing dot candidates are not adjacent to each other in the flushing pattern pertaining to each of the inkjet heads 4.

As mentioned above, in the present embodiment, the pixel matrix unit 83 including the pixels 84 arranged in an 8 by 8 matrix is taken as a basic unit. When the matrix is extended to the pixel matrix unit groups 81 and 82 that are broader than the basic unit, the matrix unit groups inherit a characteristic of the layout of flushing clot candidates arranged in the basic unit. In the basic unit, two flushing dot candidates positioned adjacent to each other in one direction (any of the first to fourth directions in the embodiment) are arranged inevitably through at least one of line of pixels extending in a direction orthogonal to the one direction (e.g., the second direction orthogonal to the first direction and the fourth direction orthogonal to the third direction).

A resolution of an image to be printed by the inkjet printer 101 of the present embodiment is a maximum of 600 dpi×600 dpi. Therefore, the virtual sheet P' corresponding to a printable area on an A4-size sheet P that is a print medium is represented by a 4961 by 7016 matrix of pixels. Therefore, as shown in FIG. 6A, the virtual area S representing a flushing pattern has a length equal to or longer than the length of the virtual sheet P' in the main scan direction (the first direction) of the inkjet head 1 and a length equal to or less than the length of the virtual sheet P' in the direction of conveyance of a sheet (the second direction). A portion of the virtual area S overlapping the virtual sheet P' corresponds to a flushing area where flushing dots are to be produced.

Figure 8:
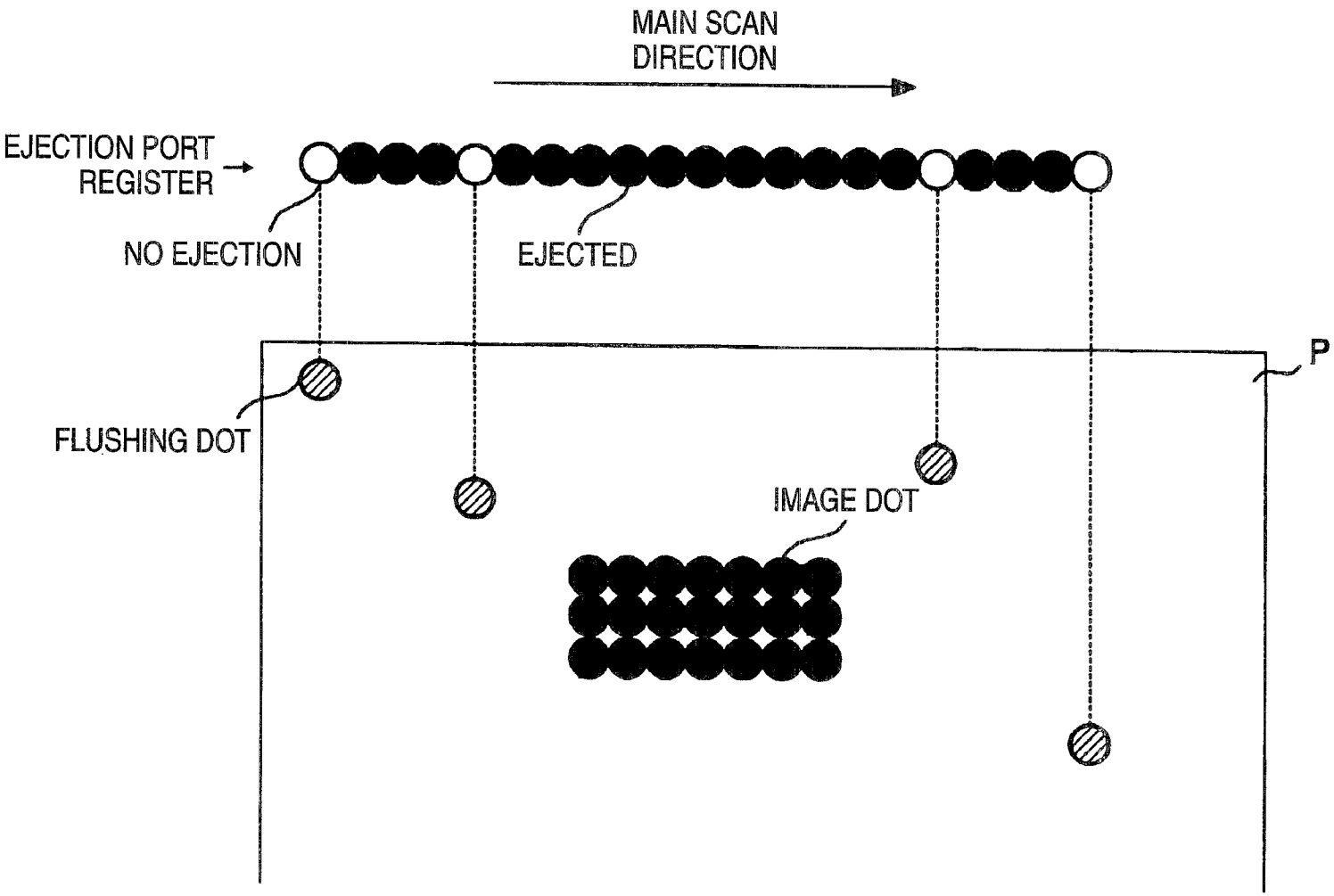
FIG. 8 is a view for describing operation of a head control section shown in FIG. 5.

Turning back to FIG. 5, the ejection port register 43 stores, at every print cycle, a fact about whether or not ink droplets have been ejected from the respective ejection ports 108, with regard to each of the four inkjet heads 1 (see FIG. 8). Storage operation is continually performed in connection with a plurality of sheets P. In the present embodiment, the maximum number of sheets P achieved at this time is set to a maximum number of sheets that can be printed within a predetermined period of time T to be described later.

Every time one sheet P undergoes printing, the ejection port register update section 44 determines, from image data stored in the image data storage section 41, whether or not ink droplets are ejected from the respective ejection ports 108 during printing. Data stored in the ejection port register 43 are updated in accordance with a result of determination. Every time ink droplets are ejected out of the ejection ports 108 by flushing operation (specifically at every predetermined time T to be described later), the ejection port register update section 44 resets the data stored in the ejection port register 43.

The conveyance control section 46 is for controlling a conveyance motor M of the conveyance unit 20 such that the sheet P is conveyed.

The head control section 45 controls ejection of ink droplets from the ejection ports 108 through the control board 54 of the inkjet head 1. Specifically, the head control section 45 determines whether or not the time elapsed since purging-and-wiping operation (to be described later) was conducted or since ink droplets were ejected out of the ejection ports 108 for flushing purpose is in excess of a predetermined time T. When determined that the elapsed time is not in excess of the predetermined time T, the head control section 45 controls ejection of ink droplets from the ejection ports 108 of each of the inkjet heads 1 such that only image dots pertaining to image data are produced on the sheet P. The predetermined time T is a time that is equal to or shorter than a period of time during which speed of ink droplets ejected from the ejection ports 108 decreases from standard speed serving as a criterion to speed that is a predetermined percentage of the standard speed as a result of drying of ink in the ejection ports 108. Further, the predetermined time T is set to the longest time during which deterioration of image quality due to a decrease in speed is allowed.

Meanwhile, when determined that the elapsed time is in excess of the predetermined time T, the head control section 45 superimposes the virtual sheet P' on the virtual area S in such a way that the virtual area S straddles the virtual sheet P' in the main scan direction and that specific pixels on the virtual sheet P' coincide with the specific pixels 84 in the virtual area S (see FIG. 6). The head control section 45 selects from the flushing pattern flushing dot candidates (the pixels 84*a* to 84*d*) located at the same locations, in the main scan direction (the second direction), where respective ejection ports 108 stored in the ejection port register 43 as not having ejected ink droplet are situated.

As mentioned above, the length of the virtual area S is equal to or longer than the length of the virtual sheet P' in the main scan direction of the inkjet head 1, and the length of the virtual area S is equal to or less than the length of the virtual sheet P' in the direction of conveyance of a sheet. The column of pixels extending in the direction of conveyance of a sheet in the virtual area S inevitably includes one flushing dot candidate. The flushing dot candidates in the portion of the virtual area S overlapping the virtual sheet P' are situated at the same locations where any of all of the ejection ports 108 of each of the inkjet heads 1 are situated, in the main scan direction. Further, the head control section 45 carries out a logical OR between image dots included in the image data and the selected flushing dot candidates.

As described in connection with the embodiment, when a matrix area having the same number of pixels in each of two mutually-crossing directions is taken as a virtual area S, the virtual area S formed in its main scan direction from the same number of pixels as those used for forming a print area is taken, as a virtual area S of the minimum size to which the present invention is applicable, with respect to the virtual sheet P' having a larger number of pixels in its direction of conveyance of sheet than in its main scan direction. In the meantime, with respect to the virtual sheet P' having a larger number of pixels in its main scan direction than in its direction of conveyance of a sheet, the virtual area S formed in its direction of conveyance of a sheet from the same number of pixels as those used for forming the print area is arranged in number of two side by side along its main scan direction in such a way that pixels are arranged at equal intervals, thereby making up a virtual area S'. The virtual area S' is taken as a virtual area S of the maximum size to which the present invention is applicable. In this case, the virtual area S is formed, in its direction of conveyance of a sheet, from pixels that are less in number than the pixels of the print area. When the virtual area S is arranged adjacently to each other in its main scan direction, the virtual area S' can also be formed from the minimum number of virtual areas S at which the total number of pixels achieved in the main scan direction becomes equal to or greater than the total number of pixels of the virtual sheet P'. Memory capacity required for the virtual area S' can thereby be decreased.

As shown in FIG. 8, in accordance with the logical OR product between the image dots and the selected flushing dot candidates, the head control section 45 controls ejection of ink droplets from the ejection ports 108 of the respective inkjet heads 1 in such a way that flushing dots corresponding to the image dots and the flushing dot candidates included in the logical OR product are formed on the sheet P conveyed to the conveyance unit 20. Ink droplets are thereby ejected at least once from all of the ejection ports 108 of the respective inkjet heads 1 every time the predetermined period of time T elapses. FIG. 8 shows only black image dots and flushing dots.

Figure 9:
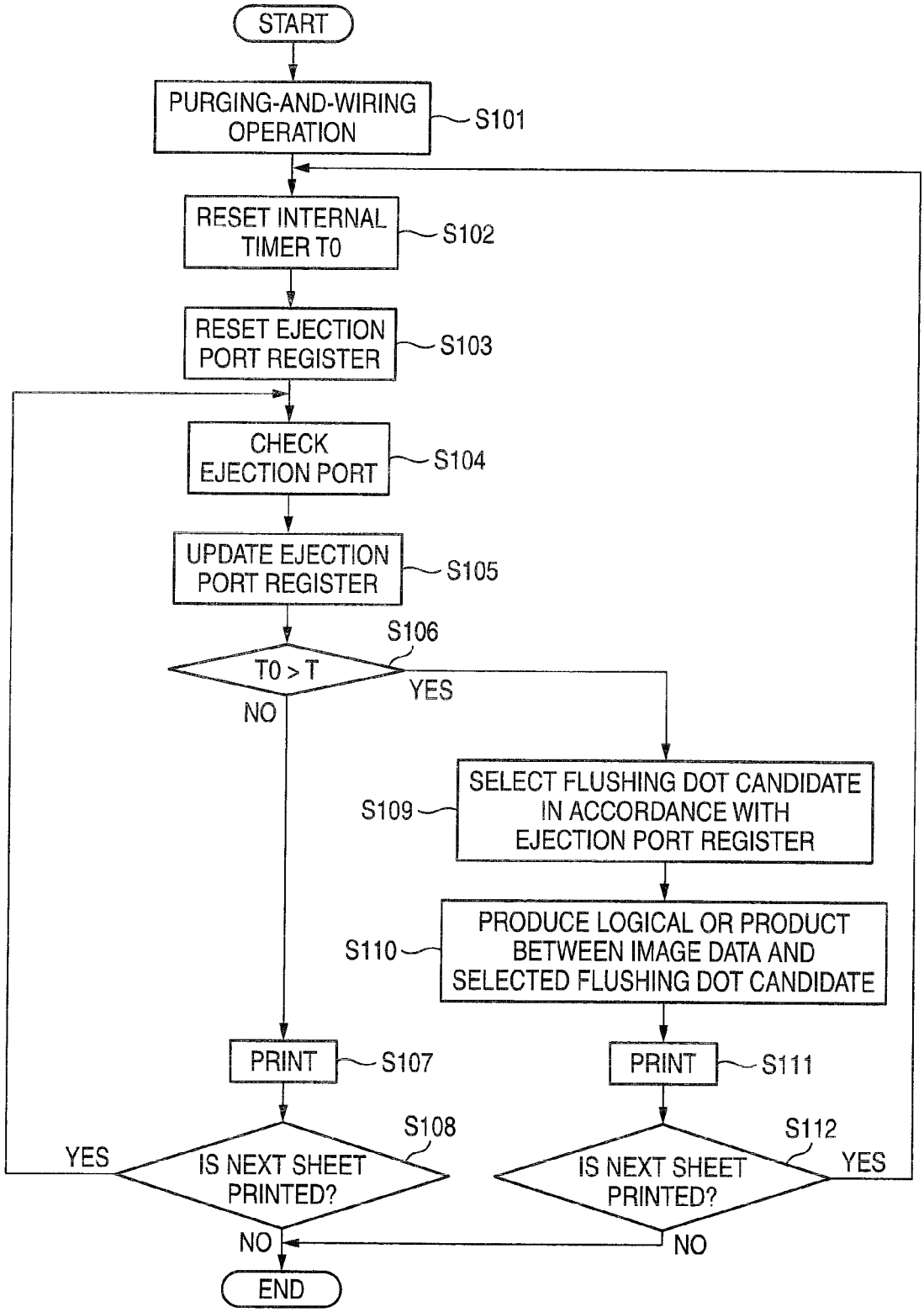
FIG. 9 is a flowchart showing operating procedures of the controller shown in FIG. 5.

Operation procedures of the controller 16 are now described by reference to FIG. 9. As shown in FIG. 9, upon receipt of a print start command from a high-level computer, purging-and-wiping operation is performed (S101). Purging-and-wiping operation is for forcefully supplying ink from an unillustrated ink supply pump to the respective inkjet heads 1, to thus purge (discharge) ink from the ejection ports 108, and subsequently wiping the ejection surface 2*a* by an unillustrated wiper. Ink whose viscosity is increased in the inkjet head 1 and impurities can be forcefully discharged to the outside, and meniscuses formed over the respective ejection ports 108 can be shaped by performance of purging-and-wiping operation. Ink ejection characteristics of the respective ejection ports 108 are recovered and maintained.

The ejection port register update section 44 resets an internal timer T0 (S102), and the data stored in the ejection port register 43 are reset so that a fact that ink droplets are not ejected from all of the ejection ports 108 pertaining to the respective inkjet heads 1 is stored in the ejection port register 43 (S103). According to image data stored in the image data storage section 41, the ejection port register update section 44 determines whether or not ink droplets are ejected from the respective ejection ports 108 with regard to printing of image data (S104). In accordance with a result of determination, data stored in the ejection port register 43 are updated for each sheet P1 (S105).

Subsequently, the head control section 45 determines whether or not the value of the internal timer T0 surpasses the predetermined time T (S106). When the head control section 45 determines that the value of the internal timer T0 does not surpass the predetermined time T (NO in S106), the head control section 45 controls ejection of ink droplets from the ejection ports 108 of each of the inkjet heads 1 in such a way that only image dots pertaining to image data are produced (printed) on the sheet P without formation of flushing dots on the sheet P conveyed to the conveyance unit 20 (S107). When printing of the sheet P is completed, the controller 16 determines whether to subject the next sheet P to printing (S108). When the next sheet P is subjected to printing (YES in S108), processing again proceeds to S104, where the next sheet P is subjected to printing. Specifically, the ejection ports 108 stored in the ejection port register 43 as having ejected ink droplets are added up every time the sheet P is subjected to printing before the value of the internal timer T0 exceeds the predetermined time T. When the next sheet P is not subjected to printing (NO in S108), processing pertaining to the flowchart shown in FIG. 9 is completed.

Meanwhile, when determined that the value of the internal timer T0 surpasses the predetermined time T (YES in S106), the head control section 45 selects flushing dot candidates (pixels 84*a* to 84*d*) situated, in the main scan direction (the second direction), at the same locations where there are situated the ejection ports 108 stored in the ejection port register 43 as not having ejected ink droplets, by superimposing the virtual sheet P' on the virtual area S such that the virtual area S straddles the virtual sheet P' in the main scan direction and that specific pixels on the virtual sheet P' coincide with the specific pixels 84 in the virtual area S (S109). The head control section 45 produces a logical OR product between the image dots included in the image data and selected flushing dot candidates (S110). The head control section 45 controls ejection of ink droplets from the ejection ports 108 of each of the inkjet heads 1 such that image dots included in a result of generation and flushing dots corresponding to the flushing dot candidates are produced (printed) on the sheet P conveyed to the conveyance unit 20 (S111). Ink droplets are thereby ejected at least once from all of the ejection ports 108 of each of the inkjet heads 1 every time the predetermined time T elapses. When the sheet P has finished undergoing printing, the controller 16 determines whether to subject the next sheet P to printing (S112). When the next sheet P is subjected to printing (YES in S112), processing again proceeds to S102, where the internal timer T0 and the ejection port register 43 are reset, thereby subjecting the next sheet P to printing. When the next sheet P is not subjected to printing (NO in S112), processing pertaining to the flowchart shown in FIG. 9 is completed.

As mentioned above, in the inkjet printer 101 of the embodiment, the pixels 84*a* to 84*d*, which are flushing dot candidates, are not positioned adjacent to each other in the flushing pattern corresponding to each of the inkjet heads 1, and only one of the flushing dot candidates is arranged in the plurality of rows of pixels 84 arranged along a set of two lines extending in the first direction and the second direction. Therefore, two or more flushing dots to be produced on the sheet P along with an image are not produced on respective lines extending in the first and second directions, so that visibility of the flushing dots can be reduced. It is thereby possible to inhibit a decrease in print quality. Since a sheet P other than the sheet P on which image dots are produced is not used to produce flushing dots, wasteful consumption of the sheet P can be prevented.

The pixels 84*a* to 84*d* that are flushing dot candidates are arranged, in the flushing pattern corresponding to each of the inkjet heads 1, in such a way that one or less of the pixels is arranged in the plurality of rows of pixels 84 aligned along the set of two lines extending in the first direction and the second direction and that one or less of the pixels is arranged in the plurality of rows of pixels 84 aligned along the set of two lines extending in the third direction and the fourth direction. Therefore, the visibility of the flushing dots can further be deteriorated.

The head control section 45 produces flushing dots on the sheet P in accordance with the flushing pattern stored in the flushing data storage section 42, so that the positions of the flushing dots can readily be determined without calculation of the positions as occasions arise.

The flushing patterns can efficiently be determined by combination of the virtual area S, the pixel matrix unit groups 81*a*, the pixel matrix unit groups 82*a*, and respective layout patterns of the pixel matrix units 81*a* and the pixels 84*a* to 84*d*.

In addition, the flushing dot candidates are arranged at mutually-different positions among flushing patterns corresponding to the respective inkjet heads 1, so that an increase in the sizes of the flushing dots on the sheet P, which would otherwise be when the flushing dots overlap each other, can be prevented.

<Example Modification>

Figure 10:
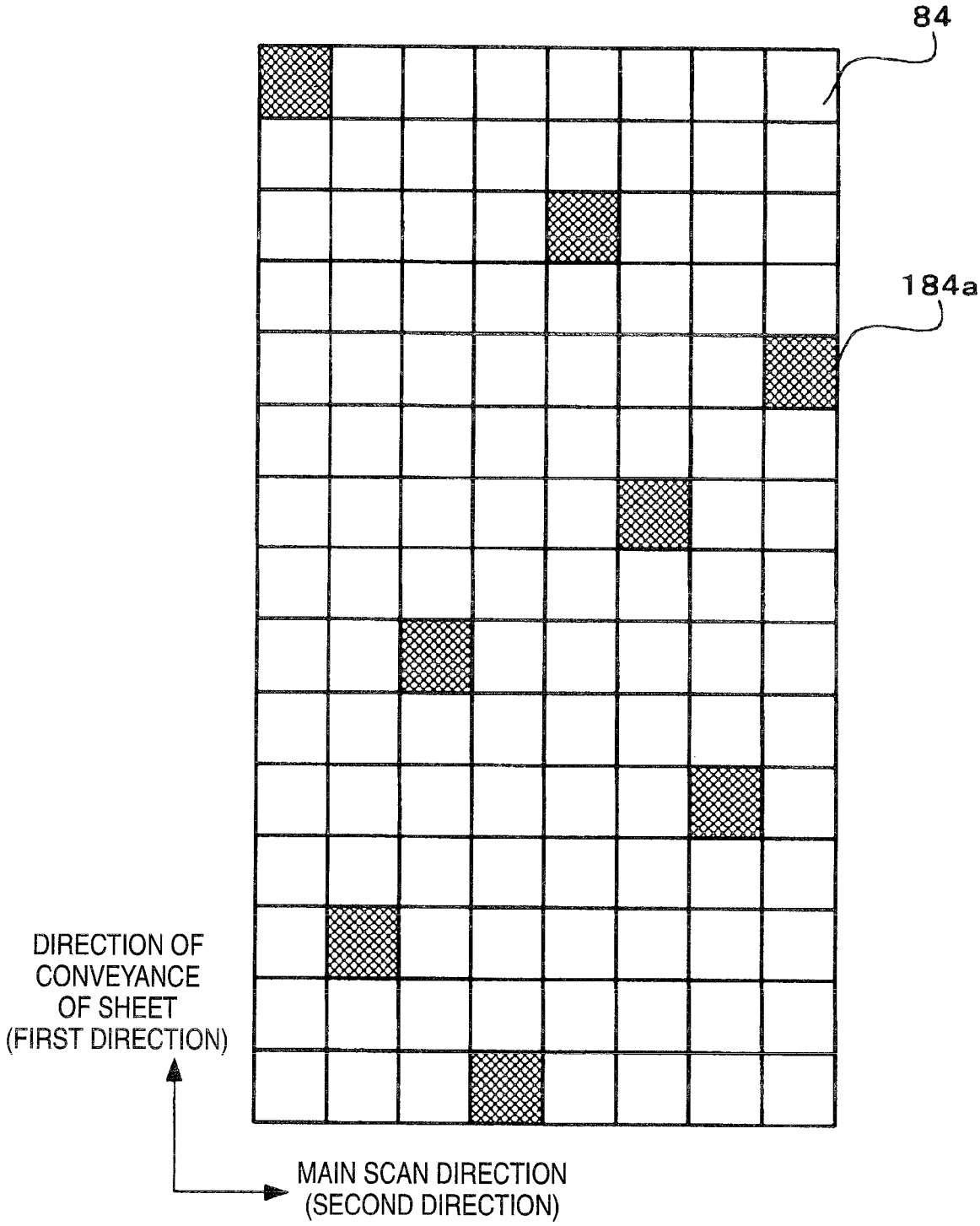
FIG. 10 is a view for describing an example modification of the embodiment.

In the foregoing embodiment, in the virtual area S corresponding to each of the inkjet heads, only one of the pixels 84*a* to 84*d* that are flushing dot candidates is arranged in each of the plurality of rows of pixels 84 aligned along the lines extending in the first direction and the second direction, and one or less of the pixels 84*a* to 84*d* is arranged in the plurality of rows of pixels 84 aligned along the set of two lines extending in the third direction and the fourth direction. As shown in FIG. 10, one or less of pixels 184*a*, which are flushing dot candidates, may be arranged in the plurality of rows of pixels 84 aligned along the lines extending in the first direction and the second direction, and the flushing dot candidates may be separated from each other at equal intervals in the second direction by an amount equal to one pixel 84. A virtual area S" has such a structure that one column of pixels extending in the main scan direction or more is added to the foregoing virtual area S in the direction of conveyance. Flushing dot candidates are not included in the column of pixels to be added.

In this case, as in the foregoing embodiment, only one of the pixels 84*a* to 84*d* is arranged in the plurality of rows of pixels 84 arranged along the line extending in the first direction. Meanwhile, two or more of the pixels 84*a* to 84*d* are arranged in at least some of the plurality of rows of pixels 84 arranged along the lines extending in the third and fourth directions. The layout pattern shown in FIG. 10 is formed for each pixel 84 aligned in the first direction, by inserting the pixels 84 arranged in the second direction into the pixel matrix unit 83*a* shown in FIG. 7. Even in the virtual area S", flushing dot candidates are arranged through at least one row of pixels in the second direction with respect to the first direction or in the first direction with respect to the second direction.

A flushing dot, which is to be produced on the sheet P along with an image, is not produced in number of two or more in respective lines extending in the first and second directions, so that visibility of the flushing dots can be reduced. Further, the flushing dots are dispersed on the sheet P in the first direction, and hence the visibility of the flushing dots can further be decreased.

In the foregoing example embodiment, flushing dot candidates belonging to a flushing pattern are equally spaced apart from each other by an amount corresponding to one pixel 84 in the first direction. The flushing dot candidates pertaining to the flushing pattern may also be separated from each other by an amount corresponding to two or more pixels 84 in the first direction. Alternatively, the flushing dot candidates pertaining to the flushing pattern may also be separated from each other by a combination of two or more distances in the first direction.

Although the preferred embodiment of the present invention has been described thus far, the present invention is not limited to the foregoing mode of implementation and is susceptible to various alternations within descriptions of the claims. Although the recording apparatus is configured in the embodiment such that the predetermined flushing pattern is stored in the flushing data storage section 42, the recording apparatus can also be configured such that flushing data are generated every time printing of one or a plurality of sheets P is started.

In the foregoing embodiment, the flushing pattern is configured so as to have a structure of a four-level hierarchy into which layout patterns; namely, the pixel matrix unit group 81*a*, the pixel matrix unit group 82*a*, the pixel matrix unit 83*a*, and the pixels 84*a* to 84*d*, are hierarchically combined together. There may also be provided a structure in which flushing data assume a hierarchical structure consisting of two to three or five or more levels, provided that the flushing dot candidates are arranged in the virtual area S so as not to be adjacent to each other and that only one of the flushing dot candidates is arranged in respective lines extending in the first and second directions. Alternatively, there may also be provided a structure that does not have such a hierarchical structure. When pixels, pixel matrix units, and pixel matrix unit groups are arranged in an n×n (m×m) matrix pattern, it is desirable that "n" (m) be four or more.

In the foregoing embodiment, the layout pattern of the pixels 84*a* to 84*d* in the pixel matrix unit 83 is equal to the layout pattern of the pixel matrix unit 83 including the pixels 84*a* to 84*d* in the pixel matrix unit group 82. The recording apparatus is configured such that the layout pattern of the pixel matrix unit groups 82 including the pixels 84*a* to 84*d* in the pixel material unit group 81 and the layout pattern of the pixel matrix unit groups 81 including the pixels 84*a* to 84*d* in the virtual area S are identical with each other. Alternatively, the layout patterns may also differ from each other.

In the foregoing embodiment, the recording apparatus may also be configured such that a different flushing pattern is used for each inkjet head 1. The recording apparatus may also be configured such that the same flushing data are used for all of the inkjet heads 1. Since the essential requirement is that the flushing data storage section 42 should store one flushing pattern, the storage capacity of the flushing data storage section 42 can thereby be reduced. In any of the configurations, from the viewpoint of the flushing dots being not noticeable, it is better to form flushing dots from a minimum quantity of ink droplet that can be ejected from the inkjet head 1. For instance, ink droplets that are smaller in quantity than that used for producing image dots may also be ejected.

In addition, in the foregoing example modification, only one of the pixels 84*a* to 84*d* is arranged in the plurality of rows of pixels 84 arranged along the lines extending in the first and second directions, and two or more of the pixels 84*a* to 84*d* are arranged in at least some of the plurality of rows of pixels 84 arranged along the lines extending in the third and fourth directions. However, the recording apparatus may also be configured such that one or less of the pixels 84*a* to 84*d* is arranged in each of the plurality of rows of pixels 84 aligned along the lines extending in the third and fourth directions and that two or more of the pixels 84*a* to 84*d* are arranged in at least some of the plurality of rows of pixels 84 arranged along the lines extending in the first and second directions.

The present invention is also applicable to a recording apparatus that ejects liquid other than ink. Further, the recording apparatus is not limited to a printer but applicable to a facsimile, a copier, and the like. Further, the present invention is also applicable to a computer readable recording memory storing a program which causes the recorder to function as described above. In the above exemplary embodiments, the EEPROM storing the program is employed as an example of the computer readable recording medium according to the invention. However, the computer readable recording medium according to the invention is not limited to the EEPROM. The computer readable recording medium according to the invention may be any computer readable recording medium, such as a hard disk, an optical disk (CD-ROM, DVD-ROM, etc.), flash memory and the like, storing the program.

What is claimed is:

1. A recording apparatus comprising:

a liquid ejection head including a plurality of ejection ports for ejecting droplets toward a recording medium;

an image data storage configured to store image data showing positions of a plurality of image dots which make up an image to be produced on the recording medium by the droplets ejected from the liquid ejection head;

a head controller configured to control ejection of droplets from the liquid ejection head; and a layout data storage configured to store, in advance of producing the image, layout data representing positions of flushing dot candidates that can serve as the flushing dots for each ejection port;

wherein the head controller:

controls the liquid ejection head according to the image data stored in the image data storage so that plurality of image dots are formed on the recording medium by droplets ejected from the ejection ports; and controls the liquid ejection head so that flushing dots are produced on the recording medium by droplets auxiliary ejected from the ejection ports not contributing to production of the image dots before recording on the recording medium is completed, so that the flushing dots are formed so as not to be adjacent to each other, and so that one or less of the flushing dot is formed in respective lines belonging to at least one of a set of two lines extending in a first direction and a second direction orthogonal to the first direction and a set of two lines extending in third and fourth directions that are orthogonal to each other and respectively cross with the first and second directions at the same angle, and wherein the head controller determines the flushing dots based on the layout data stored in the layout data storage and the image data.

2. The recording apparatus according to claim 1, wherein the head controller controls the liquid ejection head such that one or less of the flushing dots is formed in respective lines belonging to the set of two lines extending in first and second directions and the set of two lines extending in third and fourth directions.

3. The recording apparatus according to claim 1, wherein the layout data storage stores the layout data representing that which pixels are assigned to the flushing dot candidates in a virtual area in which a plurality of pixels corresponding to locations where the image dots and the flushing dots can be produced are arranged in a matrix pattern on a plane, the first direction corresponds to a direction of conveyance of the recording medium, and the second direction corresponds to a main scan direction in which the plurality of ejection ports are arranged, a length of the virtual area achieved along the second direction is equal to or less than a length of the recording medium achieved in a print area along the second direction, and the virtual area includes a plurality of pixel matrix units in which the pixels are arranged in an n×n matrix ($n \geqq 4$), and in each of the pixel matrix units, one or less of the flushing dot candidate is arranged in each of all pixel rows arranged in the first through fourth directions, each of the pixel rows including the plurality of pixels.

4. The recording apparatus according to claim 3, wherein the virtual area includes a plurality of pixel matrix unit groups where the pixel matrix units are arranged in an m×m matrix ($m \geqq 4$); and one or less of the pixel matrix unit is arranged in each of all pixel matrix unit rows including the plurality of pixel matrix units arranged in the first through fourth directions.

5. The recording apparatus according to claim 3, wherein in each of the pixel matrix units, one of the flushing dot candidate is arranged in each of all pixel rows arranged in the second direction.

6. The recording apparatus according to claim 1, wherein a plurality of the liquid ejection heads are provided in the recording apparatus, the layout data storage stores pieces of the layout data for each liquid ejection head, and the flushing dot candidates are provided at mutually-different positions among the pieces of layout data.

7. The recording apparatus according to claim 1, wherein a plurality of the liquid ejection heads are provided in the recording apparatus, and the head controller controls respective liquid ejection heads in accordance with the same layout data.

8. The recording apparatus according to claim 1, further comprising:

a movement mechanism for moving the recording medium relative to the liquid ejection head, wherein the first direction is a direction of conveyance in which the recording medium is conveyed by the movement mechanism, and wherein the head controller controls the liquid ejection head such that the flushing dots spaced apart from each other at equal intervals in the first direction are produced.

9. The recording apparatus according to claim 1, wherein the liquid ejection head does not move relative to the recording medium in connection with the second direction.

10. A method of controlling a recording apparatus which includes:

a liquid ejection head including a plurality of ejection ports for ejecting droplets toward a recording medium, and an image data storage configured to store image data showing positions of a plurality of image dots which make up an image to be produced on the recording medium by the droplets ejected from the liquid ejection head, the method comprising:

storing layout data representing positions of flushing dot candidates that can serve as the flushing dots for each ejection port, in advance of producing the image;

controlling the liquid ejection head according to the image data stored in the image data storage so that plurality of image dots are formed on the recording medium by droplets ejected from the ejection ports;

controlling the liquid ejection head so that flushing dots are produced on the recording medium by droplets auxiliary ejected from the ejection ports not contributing to production of the image dots before recording on the recording medium is completed, so that the flushing dots are formed so as not to be adjacent to each other, and so that one or less of the flushing dot is formed in respective lines belonging to at least one of a set of two lines extending in a first direction and a second direction orthogonal to the first direction and a set of two lines extending in third and fourth directions that are orthogonal to each other and respectively cross with the first and second directions at the same angle; and determining the flushing dots based on the layout data and the image data.

11. A non-transitory computer readable recording medium storing a program which causes a recording apparatus, which includes: a liquid ejection head including a plurality of ejection ports for ejecting droplets toward a recording medium, and an image data storage configured to store image data showing positions of a plurality of image dots which make up an image to be produced on the recording medium by the droplets ejected from the liquid ejection head, to perform:

storing layout data representing positions of flushing dot candidates that can serve as the flushing dots for each ejection port, in advance of producing the image;

controlling the liquid ejection head according to the image data stored in the image data storage so that plurality of image dots are formed on the recording medium by droplets ejected from the ejection ports; and controlling the liquid ejection head so that flushing dots are produced on the recording medium by droplets auxiliary ejected from the ejection ports not contributing to production of the image dots before recording on the recording medium is completed, so that the flushing dots are formed so as not to be adjacent to each other, and so that one or less of the flushing dot is formed in respective lines belonging to at least one of a set of two lines extending in a first direction and a second direction orthogonal to the first direction and a set of two lines extending in third and fourth directions that are orthogonal to each other and respectively cross with the first and second directions at the same angle; and determining the flushing dots based on the layout data and the image data.

* * * * *